US006920838B2

(12) United States Patent
Johns

(10) Patent No.: US 6,920,838 B2
(45) Date of Patent: Jul. 26, 2005

(54) STEERAGE WHEEL FOR VESSEL

(75) Inventor: Ian Johns, Nottinghamshire (GB)

(73) Assignee: Lewmar Limited, Hampshire (GB)

( * ) Notice: Subject to any disclaimer, the term of this patent is extended or adjusted under 35 U.S.C. 154(b) by 0 days.

(21) Appl. No.: 10/868,005

(22) Filed: Jun. 16, 2004

(65) Prior Publication Data

US 2004/0261679 A1 Dec. 30, 2004

(30) Foreign Application Priority Data

Jun. 26, 2003 (GB) ..... 0314897

(51) Int. Cl.[7] ..... B63H 25/10
(52) U.S. Cl. ..... 114/160
(58) Field of Search ..... 114/144 R, 160; 74/555

(56) References Cited

U.S. PATENT DOCUMENTS 1,459,957 A * 6/1923 Merritt ..... 74/555
1,722,151 A * 7/1929 Mantout ..... 74/555
1,847,209 A * 3/1932 Bolinas, Jr. ..... 74/555
2,106,169 A * 1/1938 Erickson ..... 74/555
2,155,123 A * 4/1939 Gerardy ..... 74/555

OTHER PUBLICATIONS

*"Marine Equipment for Sail and Power Boats", Lewmar Catalogue, 2001, see especially "Whitlock Steering Systems" at pp. 55–110.

* cited by examiner

*Primary Examiner*—Stephen Avila
(74) *Attorney, Agent, or Firm*—Burns, Doane, Swecker & Mathis, LLP

(57) ABSTRACT

A steerage wheel for a vessel such as a sailing yacht is disclosed. A rim member is attached to a hub member by a series of spokes. The rim member includes pivot mechanisms to allow sector portions of the rim member to be folded over to reduce the effective width of the steerage wheel. The spokes connecting the hub to the sector portions have releasable securing means to allow the connection between the rim member and the hub to be severed to permit folding of the steerage wheel without interference from the spokes. The releasable seeming means is a screw threaded sleeve that allows connection and detachment of the free ends of two lengths of the spoke.

9 Claims, 3 Drawing Sheets

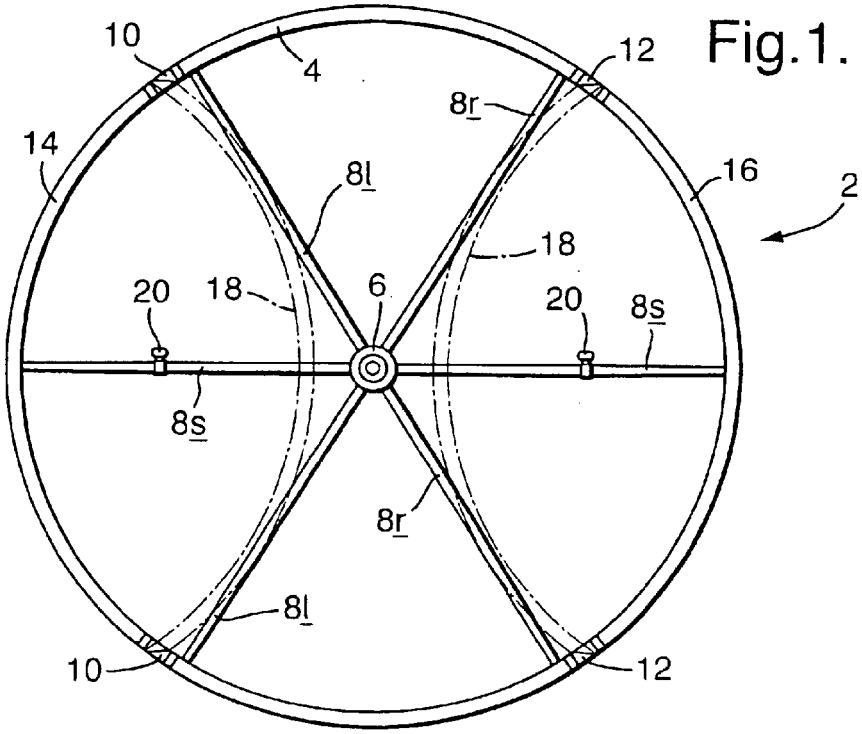
Fig.1.
Fig.7.
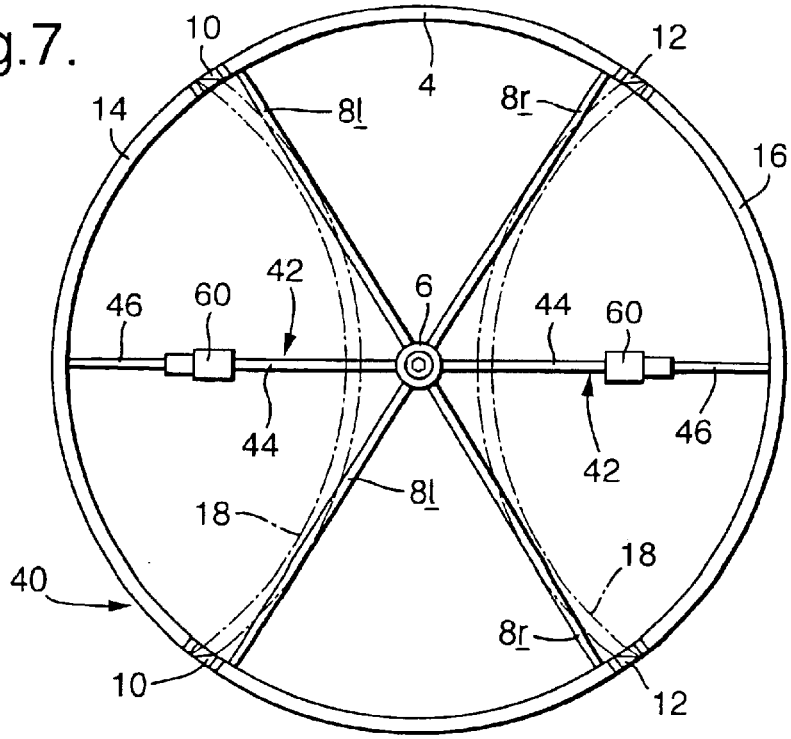

STEERAGE WHEEL FOR VESSEL

BACKGROUND TO THE INVENTION

1. Field of the Invention

This invention relates to steerage wheels for vessels, primarily but not exclusively large recreational craft, such as yachts and power driven boats, for leisure or racing use.

2. Related Art

Steerage wheels for such craft are usually large, for example between 1 meter and 2.5 meters in diameter. This can give rise to problems in steering the vessel, if space is limited in the steering area, for example because of large numbers of personnel or large numbers of items on deck. Such steerage wheels comprise a peripheral rim member for manually gripping the wheel, connected by a number of radial spokes to a central hub member. It is known to provide a means of folding two opposite sectors of the wheel over onto the remainder of the wheel, so as to reduce the effective width of the wheel, in one direction. This arrangement is more fully described below with reference to the drawings, but essentially comprises pivot mechanisms located in the rim for permitting sector portions of the rim to be folded over. A problem arises in that one or more spokes are necessarily fixed to these sector portions to provide rigidity of the wheel in its open condition, but that this interferes with the folding operation. It has therefore been proposed to provide additional pivot mechanisms in such spokes.

SUMMARY OF THE INVENTION

Problems arise when using additional pivot mechanisms because initial alignment of the pivot mechanisms on the spokes with the fold sector lines defined by the pivots in the rim, and that wear and tear or knocks arising in use, may create misalignment of the pivot mechanisms, and hence impede or prevent a folding movement.

The present invention has been devised with a view to addressing such problems or preferably to avoid, reduce or ameliorate such problems.

In a general aspect, the present invention provides releasable securing means in a spoke that is selectively releasable from a fixed configuration to a severed configuration.

In a first preferred aspect, the present invention provides a steerage wheel for a vessel, comprising a peripheral rim member for manual gripping, a central hub member, and a plurality of spokes extending radially between the hub member and the rim member, and the rim member including a plurality of pivot mechanisms for permitting separately folding over of two sector portions of the rim member so as to reduce the effective width of the steerage wheel, wherein a respective spoke is connected to the or each sector portion, and the respective spoke is formed with a releasable securing means that is selectively releasable from a configuration in which the spoke is fixed between the rim and the hub, and a configuration in which the fixing of the spoke between the hub and rim is severed.

In accordance with the invention, once the fixing of the spoke is in the severed configuration, the rim sector portion can be folded without any substantial interference by the spoke. Wear and tear etc. will not affect this freedom of movement, for example when the steerage wheel is desired to be used in its open and expanded state, the sector portion can be folded out, and the spoke returned to the fixed configuration by re-securing the releasable securing means.

Preferably, for one foldable part of the rim member, two pivot mechanisms are provided for allowing folding of the foldable part of the rim member, at the circumferential extent of said foldable part. Typically, an imaginary line joining said pivot mechanisms when the wheel is in the unfolded state defines-said sector portion to be folded over.

The releasable securing means may take any convenient form. For example the spoke may be formed with telescopic portions. This may allow it to be retracted from positioning apertures in the hub and/or rim, to disconnect the spoke from the wheel. Alternatively, one or each end of the spoke may have a spring-loaded member therein, e.g. for fitting in positioning apertures. Alternatively for example the spoke may be formed in two lengths, at least one length being formed telescopically so that it can be withdrawn from a position in which it is coupled to the other spoke length.

As preferred however, the spoke is formed in two lengths, whose free ends are disposed in a region approximately or substantially coincident with the imaginary sector line of the foldable rim sector portion. Said free ends may have cooperating releasable attachment means allowing fixing and severing of the spoke between the rim and the hub. For example, a screw-threaded sleeve may be provided, freely mounted on one spoke length and being slidable and rotatable to engage a screw thread formed on the end of the other spoke length. Thus in the secured position, the spoke may be rigidly fixed between the hub and rim and providing its proper reinforcing function, whereas when the sleeve is unscrewed and moved away from the free ends, the fixing may be severed. This configuration permits the sector portion to be folded over the remainder of the wheel, without interference from the spoke.

The screw-threaded sleeve may be provided with a tapering bore at its end distal from the screw-threaded portion. Typically, this tapering bore cooperates with a correspondingly tapering portion of said one length of the spoke. Preferably, when the sleeve is screwed onto the other spoke length, the tapering bore cooperates with the tapered portion of the spoke to wedge the sleeve and spoke together to define a limit for the screw engagement of the sleeve and the other spoke length.

In some steerage wheels, each spoke may comprise a double spoke arrangement for extra reinforcement, with two separate spokes positioned above and below each other. Preferably, in that case, each spoke of a double spoke arrangement is separately severable, as described above.

BRIEF DESCRIPTION OF THE DRAWINGS

In order that the invention may be more fully understood, a preferred embodiment is set out below by way of example and with reference to the following drawings in which:

FIG. 1 is a plan view of a prior art steerage wheel incorporating a means for reducing the width of the wheel;

FIG. 7 is a schematic plan view of the embodiment, showing open and folded configurations.

DESCRIPTION OF THE PREFERRED EMBODIMENTS

Figure 2:
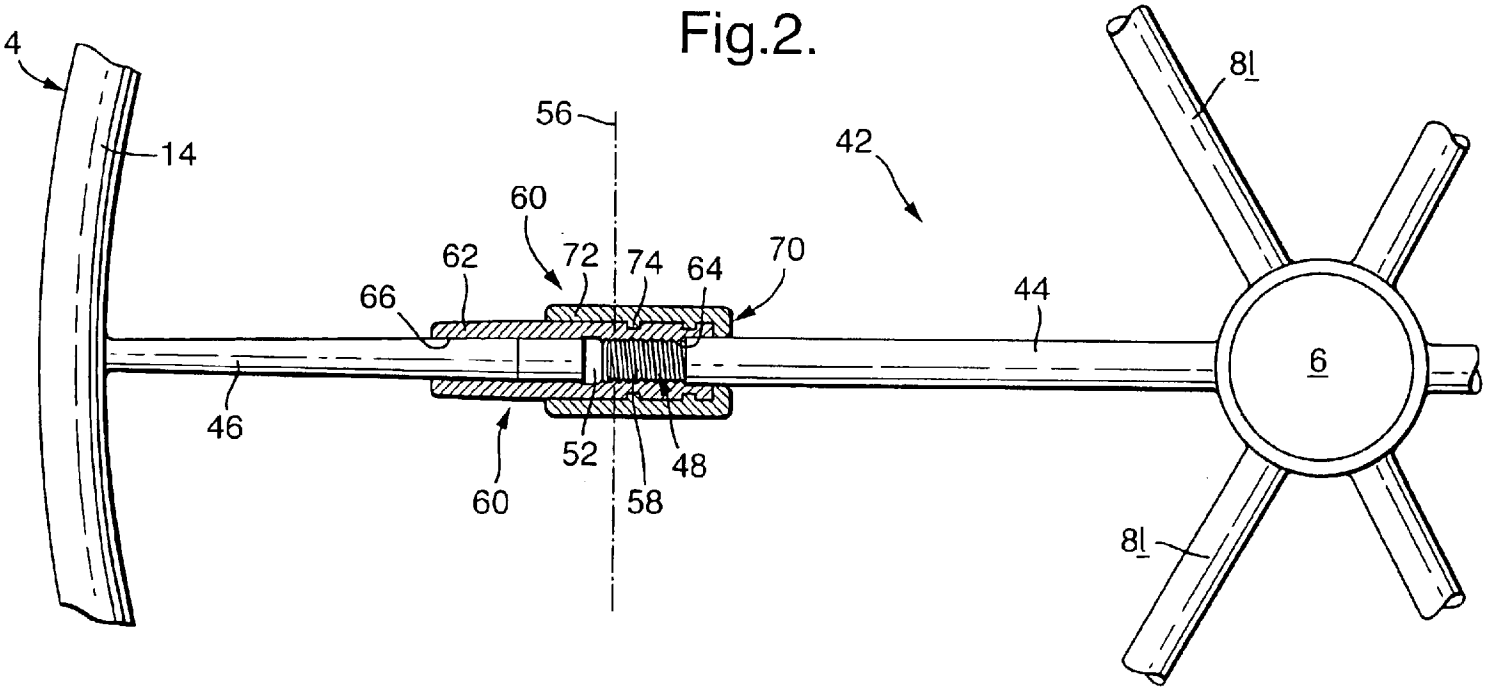
FIGS. 2 and 3 are detailed fragmentary views of the preferred embodiment of a steerage wheel of the invention, showing a reinforcing spoke in a secured rigid configuration and a severed configuration.

Referring firstly to the prior art steerage wheel for a recreational craft shown in FIG. 1, the known type of steerage wheel 2 comprises a tubular peripheral rim member 4 that in use is gripped manually. The wheel shown is 1.3 meters in diameter. A central hub member 6 has fixed spokes 8, six in number and equally spaced, extending radially between the hub and rim.

The rim 4 contains two pairs of pivot mechanisms 10, 12. Each pair defines a respective sector rim portion 14, 16 between the pivot mechanisms. Each sector rim portion 14, 16 can be folded over by reason of the pivot mechanisms, to the position 18 shown in dotted lines, in order to reduce the effective width of the steerage wheel, by removing the two opposite sectors of the wheel.

As can be seen in FIG. 1, pivots 10 are disposed to the left of spokes 8*l*, whereas pivots 12 are disposed to the right of spokes 8*r*, the pivots 10, 12 subtending an angle of 70 degrees therebetween; this is in order that spokes 8*l* and 8*r* do not interfere with the folding operation.

Spokes 8*s*, however extend to sector portions 14, 16 in order to support the sector portions in the fully extended open position of the wheel. Spokes 8*s* are therefore provided with pivot mechanisms 20 along their length, at a position where the imaginary sector lines defined by pivots 10, 12 intersect the spokes 8*s*. These pivot mechanisms are actuated simultaneously with pivots 10, 12 in order to permit folding of the sector portions. As noted above however, such an arrangement is prone to misalignment, making it difficult or impossible to complete the folding operation.

Figure 3:
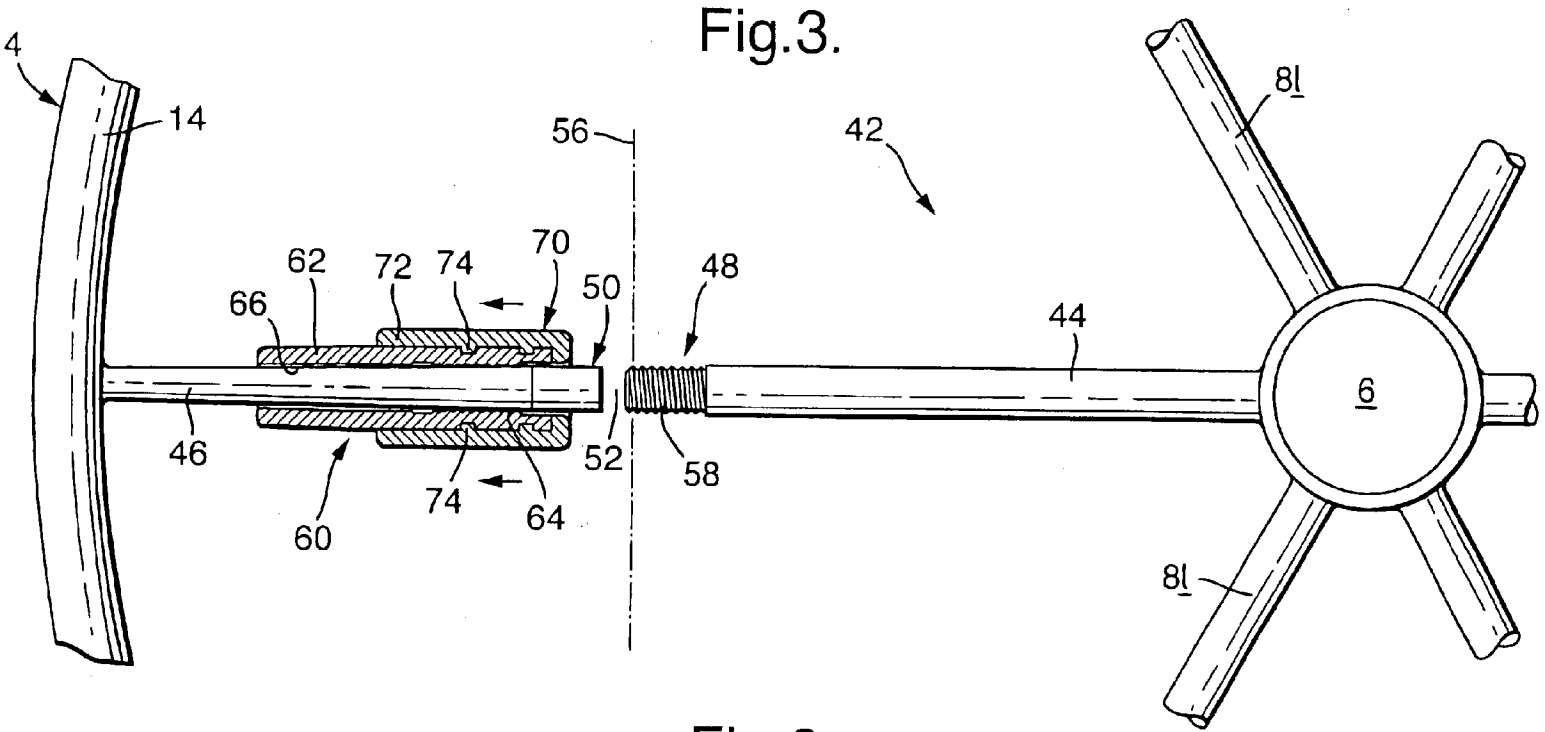

In the preferred embodiment shown in FIGS. 2 to 7, similar parts to those of FIG. 1 are denoted by the same reference numerals. In FIG. 7, it may be seen that the overall configuration of the steerage wheel 40 is generally similar to that of wheel 2, with sector portions 14, 16 being foldable from an open extended position, to the folded position 18 indicated in dotted lines, in order to reduce the effective width of the wheel. A principal difference resides in supporting spokes 42 that support the sector rim portions 14, 16 in the open position. Referring to FIGS. 2 and 3, each spoke 42 comprises first and second lengths 44, 46, whose free ends 48, 50 are spaced by a gap 52, about 1 cm in width, in the severed configuration as shown in FIG. 3. An imaginary sector line 56 between the pivots 12 on the rim intersects with gap 52.

The free end 44 of spoke length 48 has a screw thread 58. A freely rotatable and slidable releasable securing member 60 is mounted on second spoke length 46. Member 60 is formed of two parts, a first part comprising an inner tubular aluminum sleeve 62 which slides along spoke length 46, having an internally screw threaded portion 64 for engaging screw thread 58. Spoke length 46 tapers outwardly from rim 4, and sleeve 62 has a matching inwardly tapering portion 66 that is dimensioned so as to prevent the member 60 sliding off the spoke length.

Figure 5:
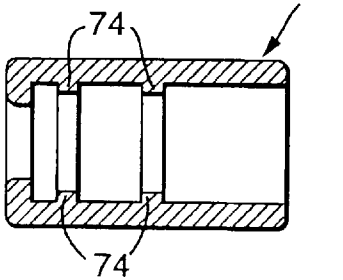
FIGS. 4 to 6 are detail views of parts of the preferred embodiment.
Figure 4:
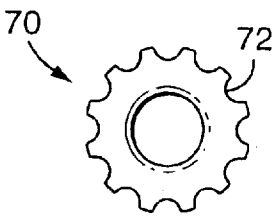

A second part of securing member 60 comprises an outer plastic injection moulded part 70, shown in more detail in FIGS. 4 and 5, with a knurled exterior 72. It engages in inner grooves 74 in sleeve 62, in order to fix part 70 to sleeve 62. Exterior 72 permits gripping of member 60 so as to move it from the severed configuration shown in FIG. 3 towards the fixed configuration shown in FIG. 2 so that the inner screw thread 64 engages screw thread 58. Member 60 may then be rotated by means of the knurled exterior so that screw thread 64 is fully screwed on to thread 58, in the position shown in FIG. 3. In this position, the tapering spoke portion 66 fully engages the matching spoke dimensions. The natural resilience within the steerage wheel permits the free ends 48, 50 of the spoke lengths to close the gap 52 and abut one another, thus forming a strong rigid spoke fixed between the hub and rim.

In operation, if it desired to reduce the diameter of the steerage wheel, folding the sectors 14, 16 from the open position to the folded (dotted line) position of FIG. 7, then it is firstly necessary to sever the fixing of the spoke between hub and rim. In the open position of the wheel, the spoke 42 is in the position of FIG. 2, with the spoke lengths 44, 46 rigidly held together. The releasable securing member 60 is gripped by means of the knurled exterior 72, and is unscrewed from threaded end 56, so that the severed configuration of FIG. 2 is adopted, with the two spoke lengths 44, 46 disconnected and spaced by a gap 52. This then permits folding of sector portions 14, 16 about pivot pairs 10, 12 to dotted lime position 18.

Figure 6:
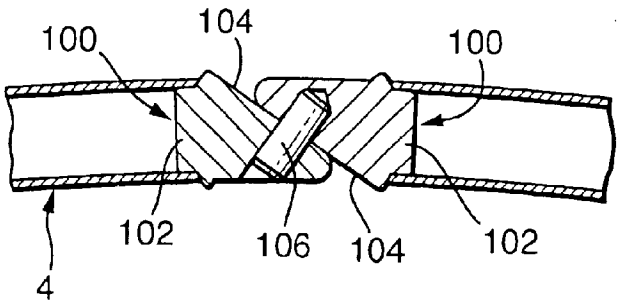

Pivots 10, 12 are shown in more detail in FIG. 6. Each pivot comprises two members 100, each member having a tubular portion 102 for making a force fit within rim 4, and an angled flat 104 for cooperating with the flat of the other member 100. An internal pin 106 holds the two flats together. The two members 100 can rotate relative to one another about cooperating flats 104, to permit pivoting movement.

There has thus been shown and described a steerage wheel which overcomes the problems of the prior art steerage wheels, and which provides a simple but effective mechanism for reducing the width of the steerage wheel as and when desired. It will be understood that modifications of the described embodiments, further embodiments and modifications thereof will be apparent to the skilled person on reading this disclosure and as such are within the spirit and scope of the present invention.

What is claimed is:

1. A steerage wheel for a vessel, comprising:

a peripheral rim member for manual gripping;

a central hub member;

a plurality of spokes extending radially between the hub member and the rim member;

a plurality of pivot mechanisms included in the rim member for permitting separately folding over at least two sector portions of the rim member so as to reduce an effective width of the steerage wheel, wherein a respective spoke is connected to each sector portion, and the respective spoke is formed with a releasable securing means that is selectively releasable from a configuration in which the spoke is fixed between the rim and the hub, and a configuration in which the fixing of the spoke between the rim and hub is severed.

2. A steerage wheel according to claim 1 wherein, for one foldable part of the rim member, two pivot mechanisms are provided for allowing folding of said sector portion of the rim member.

3. A steerage wheel according to claim 1 wherein the respective spoke is formed with telescopic portions to allow it to be retracted from said configuration in which the spoke is fixed between the rim and the hub to said configuration in which the fixing of the spoke between the rim and the hub is severed.

4. A steerage wheel for a vessel, comprising:

a peripheral rim member for manual gripping;

a central hub member;

a plurality of spokes extending radially between the hub member and the rim member;

a plurality of pivot mechanisms included in the rim member for permitting folding over of at least one sector portion of the rim member so as to reduce an effective width of the steerage wheel, wherein a respective spoke is connected to the or each sector portion, and the respective spoke is formed with a releasable securing means that is selectively releasable from a configuration in which the spoke is fixed between the rim and the hub, and a configuration in which the fixing of the spoke between the rim and hub is severed;

wherein the respective spoke has a spring-loaded member therein to allow it to be fitted between said configuration in which the spoke is fixed between the rim and the hub and said configuration in which the fixing of the spoke between the rim and the hub is severed.

5. A steerage wheel according to claim 1 wherein the respective spoke is formed in two lengths, free ends of said two lengths being substantially coincident with an imaginary sector line of the foldable rim sector portion.

6. A steerage wheel according to claim 5 wherein the releasable securing means comprises respective cooperating releasable attachment means at said free ends of the two lengths of the spoke.

7. A steerage wheel for a vessel, comprising:

a peripheral rim member for manual gripping;

a central hub member;

a plurality of spokes extending radially between the hub member and the rim member;

a plurality of pivot mechanisms included in the rim member for permitting folding over of at least one sector portion of the rim member so as to reduce an effective width of the steerage wheel, wherein a respective spoke is connected to the or each sector portion, and the respective spoke is formed with a releasable securing means that is selectively releasable from a configuration in which the spoke is fixed between the rim and the hub, and a configuration in which the fixing of the spoke between the rim and hub is severed;

wherein the respective spoke is formed in two lengths, free ends of said two lengths being substantially coincident with an imaginary sector line of the foldable rim sector portion;

wherein the releasable securing means comprises respective cooperating releasable attachment means at said free ends of the two lengths of the spoke; and wherein one of the releasable attachment means is a screw-threaded sleeve freely mounted on one of the spoke lengths, slidable and rotatable to engage a screw thread formed on the other spoke length.

8. A steerage wheel according to claim 7 wherein the sleeve is formed with a tapering bore at its end distal from the screw-threaded portion for cooperation with a correspondingly tapering portion of said one of the spoke lengths.

9. A steerage wheel according to claim 1 comprising a double spoke arrangement and wherein each spoke of said double spoke arrangement is separately severable.

* * * * *